US005211240A

United States Patent [19]

Gadelle et al.

[11] Patent Number: 5,211,240

[45] Date of Patent: May 18, 1993

[54] METHOD FOR FAVORING THE INJECTION OF FLUIDS IN PRODUCING ZONE

[75] Inventors: Claude Gadelle, Rueil-Malmaison; Jacques Lessi, Maule; Hervé Petit, Paris, all of France

[73] Assignee: Institut Francais du Petrole, Rueil-Malmaison, France

[21] Appl. No.: 787,658

[22] Filed: Nov. 4, 1991

[30] Foreign Application Priority Data

Nov. 2, 1990 [FR] France ..... 90 13694

[51] Int. Cl.[5] ..... E21B 43/24

[52] U.S. Cl. ..... 166/303; 166/50; 166/269; 166/272

[58] Field of Search ..... 166/50, 272, 268, 370, 166/269, 305.1, 303

[56] References Cited

U.S. PATENT DOCUMENTS

| | | | |
|---|---|---|---|
| 4,248,302 | 2/1981 | Churchman | 166/272 |
| 4,368,781 | 1/1983 | Anderson | 166/252 |
| 4,460,044 | 7/1984 | Porter | 166/252 |
| 4,508,172 | 4/1985 | Mims et al. | 166/50 X |
| 4,565,245 | 1/1986 | Mims et al. | 166/50 |
| 4,620,594 | 11/1986 | Hall | 166/263 |
| 4,696,345 | 9/1987 | Hsueh | 166/50 X |
| 4,707,751 | 11/1987 | Ozaki et al. | 360/97 |
| 4,754,811 | 7/1988 | Ledent et al. | 166/50 X |
| 5,054,551 | 10/1991 | Duerksen | 166/50 X |
| 5,090,481 | 2/1992 | Pleasants | 166/50 X |

FOREIGN PATENT DOCUMENTS 2593854 8/1987 France .

*Primary Examiner*—Stephen J. Novosad

*Attorney, Agent, or Firm*—Antonelli, Terry, Stout & Kraus

[57] ABSTRACT

In a drain (2) fitted with a perforated casing (3), a fluid under pressure is injected in various locations by selectively changing the position of the injection points in relation to these locations by means of a pipe (4). The position of the injection ports and/or the area thereof is varied through the selective opening of valves or by displacing an injection pipe (4). The density of the perforations of the casing (3) and/or of the injection pipe (4) can also be varied. A sweeping of the reservoir crossed by the drain is achieved by injecting for example a hot gaseous fluid such as steam under pressure and the density of the perforations (11) of a pipe (4) is for example selected in such a way that the amount of heat transferred to the formation is substantially constant along the drain.

12 Claims, 2 Drawing Sheets

METHOD FOR FAVORING THE INJECTION OF FLUIDS IN PRODUCING ZONE

BACKGROUND OF THE INVENTION

The present invention relates to a method for promoting the recovery of effluents in a nonflowing producing zone crossed by at least one deflected well or drain, such as a petroliferous zone. What is called a deflected well or drain is any well at least part of which is substantially horizontal or little inclined in relation to the horizontal.

One of the interests of deflected wells is to allow a better sweeping of the oil effluents contained in the formations crossed and thereby to improve recovery. The sweeping mechanisms which are implemented can be natural or artificial. In the first case, the pressure necessary for the sweeping is supplied by an underlying or lateral aquifer, a volume of gaseous effluents topping the petroliferous zone or gas cap, etc. In the second case, water, steam or gas can be injected, or else pumping means can be introduced into the well.

Optimum recovery, for a given sweeping mechanism, is obtained when the sweeping front moved parallel to the deflected drain. The regularity of the sweeping front is sometimes difficult to keep because of heterogeneities of the reservoir, such as fractures or channels, etc, changes in the drain geometry or disturbances linked to the flows in the drain such as pressure drops when the production is activated by pumping, heat losses when the stimulation is carried out by a hot gaseous fluid, etc.

The influence of the temperature on the dynamic viscosity, on the density of the fluids in place in a deposit and on the phenomena taking place at the interfaces is well known, and the improvement of the production provided by the injection of a hot gaseous fluid in a drain drilled through a producing layer and fitted with regularly distributed lateral perforations and the efficiency thereof is linked to the amount of steam making through the formation.

It may be seen that the distribution of the rates of heat release along the drain is not linear.

As a matter of fact, during the first hours of injection, the reservoir, which initially shows a temperature very smaller than the temperature of the steam, is not only heated by the latent heat and part of the sensible heat of the condensed steam which has entered the reservoir zones close to the drain, but also by the heat losses, essentially by conduction, from the drain towards the reservoir. The quality of the steam consequently decreases from the inlet all along the drain.

After several hours or days of injection, according to the flow of steam injected, the cumulated amount of steam which has entered the reservoir has considerably increased the temperature in the zones close to the drain, and the thermal losses by conduction from the drain towards the reservoir are much less considerable than at the beginning of the injection. The quality of the steam in the drain thus increases in time, but it remains slightly decreasing along the drain.

During a sweeping achieved by the steam between two horizontal or subhorizontal drains, the injectable steam flows can be very low, so low that the steam at the end of the drain can be totally condensed during a large part of the sweeping process. The volume occupied by the hot water being insignificant in relation to the one occupied by the steam, the reservoir is not only heated in a non homogeneous way, but the sweeping front is irregular and the recovery of the oil in place in the region located between the two drains is not optimized.

SUMMARY OF THE INVENTION

The method according to the invention provides control of the application of a fluid under pressure which is injected into a producing zone crossed by at least one deflected drain into which a pipe whose lower part is fitted with at least one injection port communicating with the drain is taken down, in order to promote the recovery of effluents. It comprises using a means for injecting through the pipe a fluid under pressure and selectively varying the pressure of the fluid applied to the formation in any determined location of the drain, by selectively changing, in an appropriate way, the distance between said location and at least one port for injecting the fluid into the drain and/or the area of injection of the fluid into the drain.

According to one embodiment of the method, the pressure of the fluid applied to the formation simultaneously in a plurality of locations in part of the drain is controlled by using a pipe fitted with such a distribution of the injection ports that the effective pressure of the fluid in all these locations is substantially the same.

The appropriate pressure is obtained in any determined location for example by using a pipe fitted with at least one injection port and by varying the length of the path between said location and a port of the pipe and/or the cross-section of said port.

To that effect, the tubing can also be fitted with a plurality of ports distributed on part of the length thereof and with means for varying the cross-section of at least part of the ports, the method comprising in this case selecting at least one of said ports whose distance from said location and/or whose cross-section are selected in order to obtain a determined pressure drop in said location.

The method can also be implemented by using a pipe fitted with perforations distributed on at least part of the length thereof so that the amount of fluid injected per unit of length is substantially the same at all points of the well.

The fluid is for example steam under pressure.

According to an embodiment of the method, a hot fluid is, for example, injected and an injection pipe fitted with lateral perforations, so that the flow rate of injected fluid increases as the distance from the beginning of the injection zone becomes larger, is used.

The injection pipe is, for example, fitted with lateral perforations so that the amount of heat transferred by injection to the formation is substantially constant along the drain.

With the control of the effect obtained by displacing the injection points in relation to the different locations along the drain or by varying the application areas, it is possible to adapt the sweeping intensity of the steam according to the configuration of the producing zone and/or of the drain crossing it, simultaneously on a complete portion of the drain.

BRIEF DESCRIPTION OF THE DRAWINGS

Other features and advantages of the method according to the invention will be clear from the following description of embodiments of the method given by way of non-limitative examples and with reference to the accompanying drawings in which.

DESCRIPTION OF THE PREFERRED EMBODIMENTS

Figure 1:
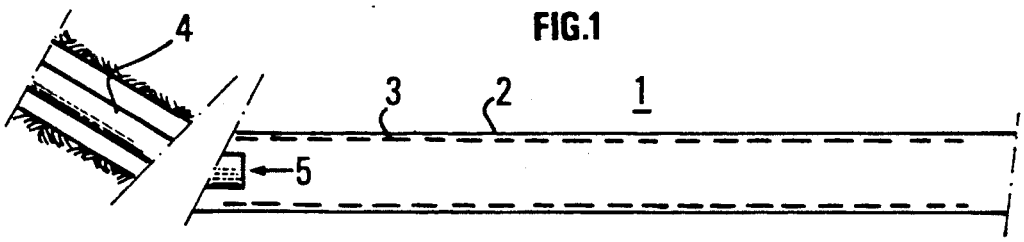
FIG. 1 diagrammatically shows a part of a production drain where an injection equipment is installed.
Figure 2:
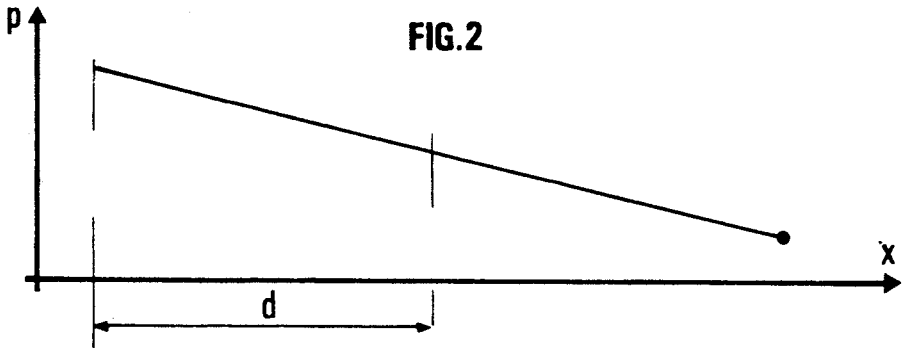
FIG. 2 shows the variation of the pressure of injection of the fluid along the drain when the injection pipe only comprises one opening at the end thereof.
Figure 5:
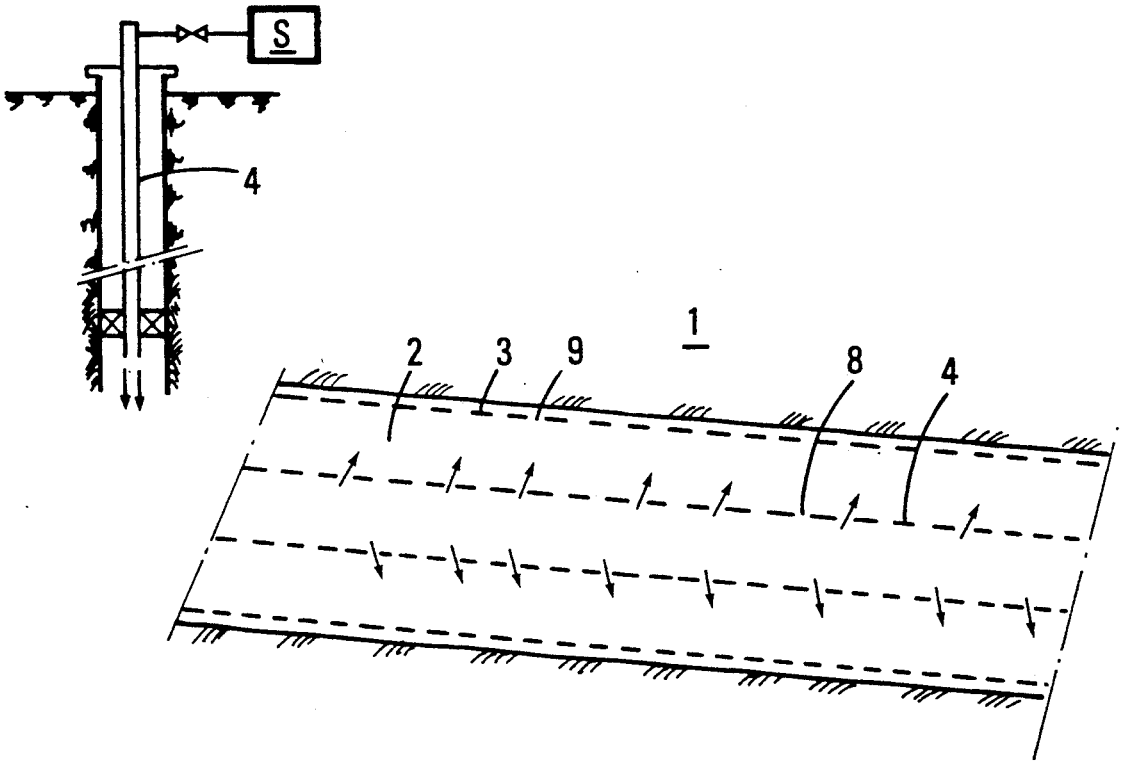
FIG. 5 diagrammatically shows another selective injection means in a subsoil zone.

The method of the invention involves the injection of a fluid under pressure and notably a hot fluid for obtaining a controlled sweeping of a producing zone. The zone 1 is crossed (FIG. 1) by a deflected well or drain 2 whose lower part is horizontal or little inclined in relation to the horizontal. The well is generally fitted with a perforated casing 3 in the part thereof crossing the producing zone. An injection pipe 4 is lowered into the zone to be activated and connected at the surface with a fluid injection system S (FIG. 5). The injection pressure p produced is maximal in proximity to the lower end 5 of the pipe 4 (FIG. 2) and, because of a pressure drop, it rapidly decreases with the distance d (FIG. 2), so that the suction pressure soon becomes insufficient to obtain a correct sweeping of the producing zone.

It is often difficult in practice to increase the pressure at the lower outlet of the pipe in order to obtain a sufficient pressure at all the points of the zone to be swept, either for reasons linked with the injection equipment or because of the structure cf the swept zone. Despite this, it often appears that such a pressure increase does not substantially improve the quality of the sweeping.

A first embodiment of the method consists in positioning the lower end of the pipe 4 coming out into the producing zone at an optimum location, so that a pressure sufficient for a good sweeping of the zone can be obtained in any location of the drain. This effect is obtained in a more efficient way if the lower end of the pipe 4 is displaced in the course of time. With this procedure, use is made of the relative position of the drain locations in relation to the injection opening.

Figure 3:
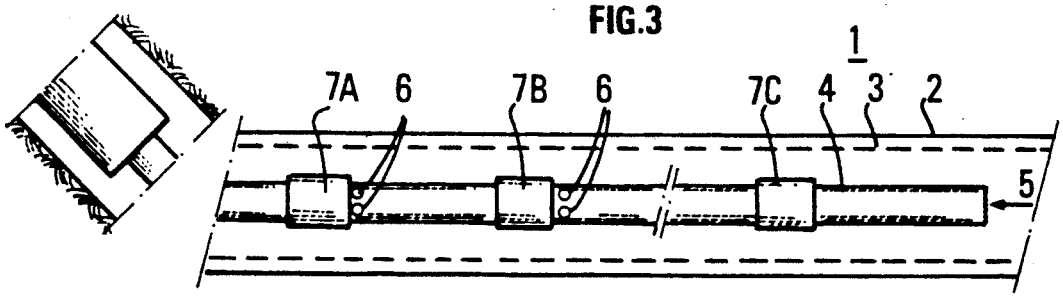
FIG. 3 shows a first embodiment of the method where a means for controlling the injection, thereby allowing a selective sweeping of the producing zone; is used.
Figure 4:
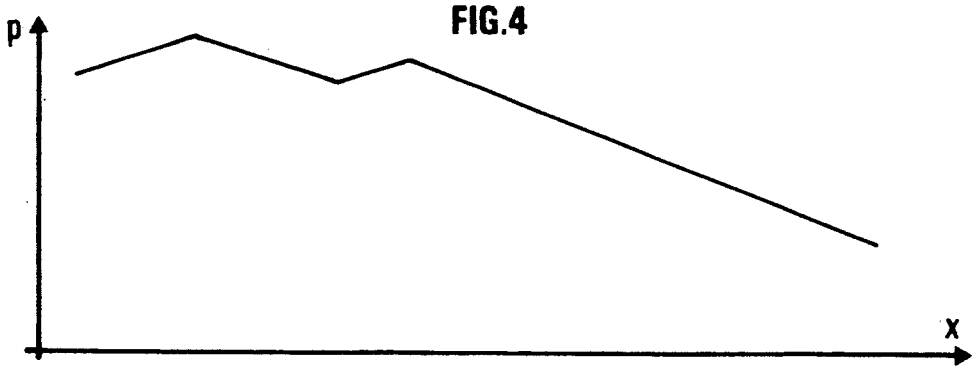
FIG. 4 shows an example of a better controlled variation of pressure obtained with the control means of FIG. 3.

A second embodiment of the method consists in using a pipe 4 whose part crossing the producing zone is fitted with a plurality of openings 6 (FIG. 3) which are opened selectively. A pipe fitted with lateral openings which can be screened and uncovered, on demand, by activating valves 7 such as sliding sleeve valves as described in the published patent application FR 2,626,614 can, be used, for example. The sliding of the sleeve allows to uncover the openings 6 either partly (valve 7A) or totally (valve 7B). With a pipe fitted with multiple openings, the selective opening of one of the valves has the effect of locally increasing the pressure of the fluid in the annulus (FIG. 4) and of regularizing the sweeping in proximity to the new opening.

Use can be made of two factors influencing the resulting pressure drop in order to obtain a certain pressure of the fluid in a location of the drain. The first factor is the distance between this location and the injection opening 5, 6, and the one of the lateral openings of the pipe which is at the appropriate distance can be selected. The second factor is the injection area which can be modified by opening more or less one of the valves 7 and/or by modifying the number of open valves.

It is also possible to combine the two embodiment by displacing a pipe fitted with controlled discharge openings for the fluid along the drain within the producing zone.

For the implementing of a preferred embodiment of the method according to the invention, which promotes the sweeping of a producing zone, the injected fluid under pressure is a hot gas for allowing a regulated production stimulation. Steam, which can convey a large amount of heat per unit of mass, is preferably utilized.

In order to homogenize the sweeping operated by the steam along drain 2, and to constitute a heat front moving parallel to the drain, an injection pipe 4 with perforations 8 on part of the length thereof is advantageously used, so that increasing inflow rates are obtained as the distance from the beginning of the injection zone becomes larger, in order to transfer to the formation a substantially equal amount of heat per drain length unit. The results are particularly interesting in the case of little permeable or porous reservoirs or reservoirs containing very viscous oils, for which the injectable steam flow rates are low and the injection times are short when they are stimulated. The increasing inflow rate along the drain can be obtained by raising the rate of lateral perforations of the pipe.

Injecting increasing steam flow rates along the drain seems essential in this case, not only from a thermal point of view, but also from a mechanical point of view, in order to provide the equality of the pressure gradients between the well lines.

This implementing of the method is therefore worthwhile in the case of the stimulation of one or several horizontal wells through steaming as in the case of a steaming between horizontal wells, the rates of perforation of the casing or the liner being different.

Increasing the rate of inflow along the drain by changing the distribution of the lateral perforations 9 in the wall of the casing 3 could be done without departing from the scope of the invention.

We claim:

1. A method for controlling the application of fluid under pressure which is injected into a producing zone crossed by at least one deflected drain, into which a pipe having a lower part fitted with at least one injection port communicating with the drain is introduced, in order to promote the recovery of effluents from a surrounding geological formation, the method comprising injecting a fluid under pressure through the pipe and selectively varying the fluid pressure applied to the formation in any determined location of the drain by appropriate selective changing of a distance between said location and the at least one port for injecting the fluid into the drain and/or an area of fluid injection via the at least one injection port communicating with the drain.

2. A method for controlling the application of a fluid under pressure which is injected into a producing zone crossed by at least one deflected drain, into which a pipe having a lower part fitted with at least one injection port communicating with the drain is introduced, in order to promote the recovery of effluents from a surrounding geological formation, the method comprising injecting a fluid under pressure through the pipe and selectively varying the fluid pressure applied to the formation in any determined location of the drain by appropriate selective changing of a distance between said location and the at least one injection port communicating with the drain; the pressure of the fluid applied to the formation simultaneously in a plurality of locations of part of the drain being controlled by using a pipe provided with such a distribution of injection ports that the effective pressure of the fluid is substantially the same in all of said locations.

3. A method as claimed in claim 1 or 2 wherein a determined pressure of the fluid in any location is obtained by using a pipe fitted with at least one injection port and by varying the length of a path between said location and a port of the pipe and/or the section of said port.

4. A method as claimed in claim 3 wherein the pipe is fitted with a plurality of ports (6) distributed on part of the length thereof and means (7) for varying the section of at least part of the ports, the method comprising the selecting of at least one of said ports whose distance from said location and/or whose section are selected to obtain in said location a determined pressure drop.

5. A method as claimed in claim 3 wherein a pipe is provided with perforations distributed on at least part of the length thereof, so that the amount of fluid injected per unit of length is substantially the same at any point of the well.

6. A method as claimed in claim 1 wherein a hot fluid is injected and the injection pipe has lateral perforations so that the flow rate of injected fluid increases as the distance from a beginning of the injection zone becomes larger.

7. A method as claimed in claim 1 wherein a hot fluid is injected and the injection pipe has lateral perforations so that the amount of heat transferred by injection to the formation is substantially constant along the drain.

8. A method as claimed in claim 1 wherein a hot fluid is injected and the drain is fitted with a casing provided with lateral perforations, so that the flow rate of the injected fluid increases as the distance from a beginning of the injection zone becomes larger.

9. A method as claimed in claim 1 wherein a hot fluid is injected and the drain is fitted with a casing provided with lateral perforations, so that the amount of heat transferred by injection of fluid to the formation is substantially constant along the drain.

10. A method as claimed in any one of claims 1, 2, 6, 7, 8 and 9 wherein the fluid is steam under pressure.

11. A method for selectively controlling the application of fluid under pressure in a producing zone for improving recovery of effluents from a geological formation by injecting the fluid through at least one deflected drain traversing said producing zone which comprises positioning in said deflected drain an injection pipe connected to a fluid source, and providing said injection pipe with a plurality of injection ports opening in said deflected drain and distributing fluid at selected different places along said deflected drain by a selective opening of the injection ports, thereby controlling the distance between each of said places and the injection ports.

12. A method for selectively controlling the application of fluid under pressure to a producing zone for improving recovery of effluents from a geological formation by injecting the fluid through at least one deflected drain traversing said producing zone which comprises positioning in said deflected drain an injection pipe connected to a fluid source and providing said injection pipe with a plurality of injection ports opening in said deflected drain with selectable opening areas and distributing fluid at selected different places along said deflected drain by a selective opening of said injection ports, thereby controlling the distance between each of said places and the injection ports and/or the respective opening areas of said injection ports.

* * * * *